United States Patent [19]

Gulsby et al.

[11] 4,453,958

[45] Jun. 12, 1984

[54] GREATER DESIGN CAPACITY-HYDROCARBON GAS SEPARATION PROCESS

[75] Inventors: Jerry G. Gulsby; G. Dennis Cook, both of Kingwood, Tex.

[73] Assignee: Gulsby Engineering, Inc., Kingwood, Tex.

[21] Appl. No.: 444,436

[22] Filed: Nov. 24, 1982

[51] Int. Cl.[3] ..... F25J 3/02

[52] U.S. Cl. ..... 62/28; 62/39

[58] Field of Search ..... 62/38, 39, 23, 24, 27, 62/28

[56] References Cited

U.S. PATENT DOCUMENTS 4,203,742 5/1980 Agnihotri ..... 62/38

*Primary Examiner*—Frank Sever

*Attorney, Agent, or Firm*—Ranseler O. Wyatt

[57] ABSTRACT

A process for recovery of components of volatile gas containing methane and heavier components, by a cryogenic process, cooling the incoming raw gas and separating the desired products by distillation, wherein the feed gas is divided into two streams, one being primarily liquid, which is expanded to lower the pressure and then fed into the demethanizer tower at a selected point, and the other stream, being primarily gas, is divided and expanded and discharged into the demethanizer at selected positions to place the streams in the demethanizer to accomplish maximum separation and recovery of the desired components in either an ethane recovery mode or an ethane rejection mode, the pressures and temperatures of the demethanizer being adjustable for either.

5 Claims, 1 Drawing Figure

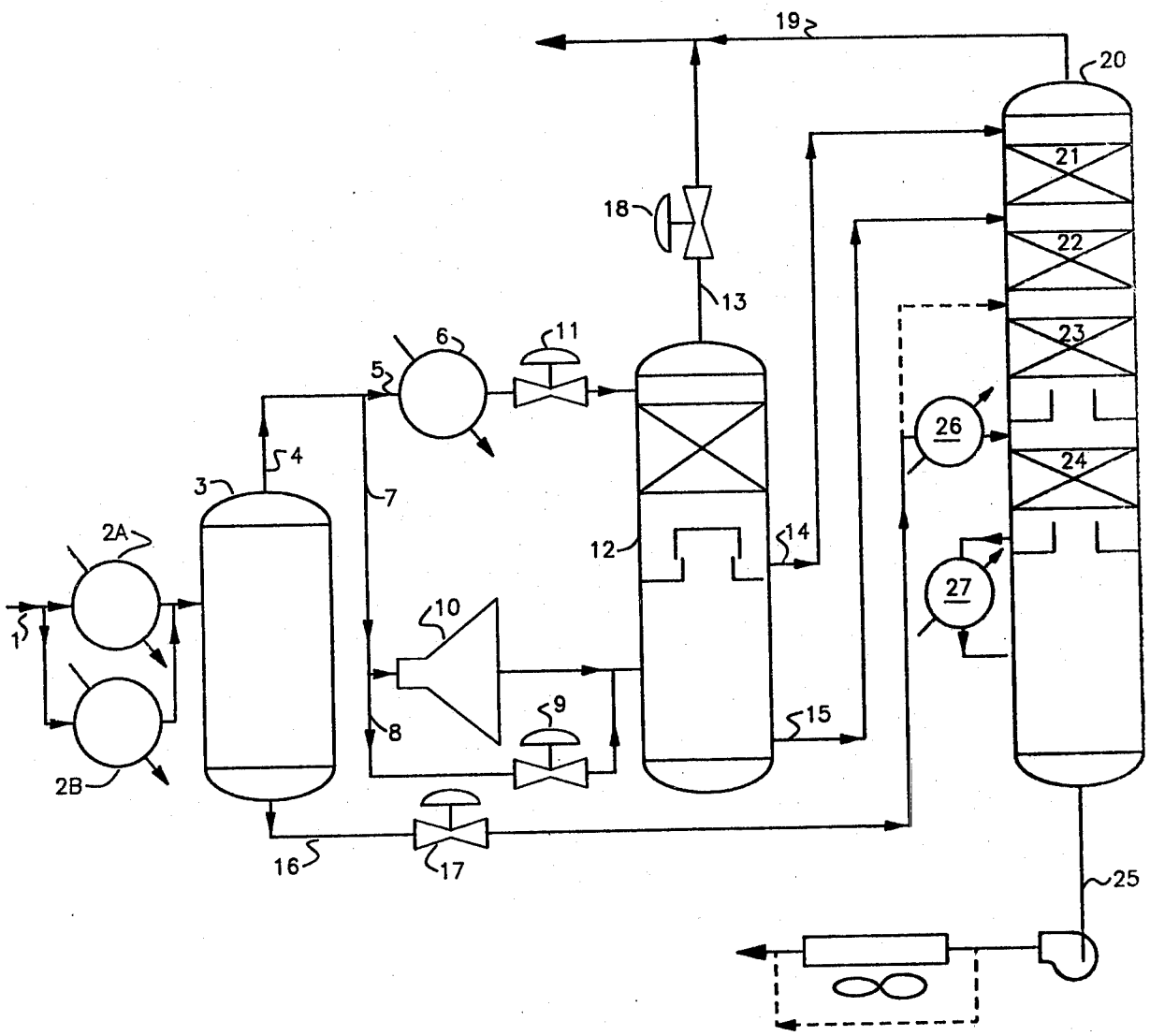
19
20
21
22
23
24
18
13
11
6
5
26
4
3
7
2A
12
14
27
1
10
9
15
8
2B
16
17
25

GREATER DESIGN CAPACITY-HYDROCARBON GAS SEPARATION PROCESS

BACKGROUND OF THE INVENTION

Hydrocarbon gas separation by means of cryogenics has been employed in the gas processing industry for many years, the components of feed gas being readily susceptible to separation through pressure and temperature changes. A demethanizing column is customarily employed wherein the feed gas is heated and the vapors drawn off from the top of the column, and the liquid from the bottom. The column contains either beds consisting of metallic packing or equilibrium trays to aid in the separation process. It is desirable to draw off as much as of the vapors as possible prior to introduction of the liquid into the column. It is an object of this invention to accomplish a maximum separation of the raw feed gas components with a minimum utility consumption.

SUMMARY OF THE INVENTION

This is a process for recovery of desired components of a gaseous feed stream wherein the feed stream is divided, cooled, then separated into two main streams, one primarily vapor and the other primarily liquid, the first being primarily vapors, is again divided into two parts, part one is cooled and expanded to lower the pressure and temperature, and directed into a two-stage separator, and part two, being primarily vapors, is selectively divided, one stream passing through controlled expansion means and back into the feed line and the other stream passing through an expander, and the combined stream passing into the bottom section of the two-stage separator, wherein the vapors pass from the lower section of the intermediate separator vessel into the upper section where they contact the liquid portion of part one, thus removing some of the heavier components from the vapor and retaining them in the liquid of part one. The remaining vapor from part two combines with the vapor from part one to form a lean gas stream which enters a conduit to combine with the demethanizer column overhead vapors to form the residue gas. The demethanizer column is a standard medium for the final separation of vapors and liquid and consists of a cylindrical vessel having a series of sections or beds, or packing of trays. The liquid from part one with those components removed from the vapor from part two, enter a separate conduit and are fed onto the top of the topmost packed, or trayed, section of the demethanizer. The liquid from part two enters another separate conduit and is fed onto the next lower packed, or trayed, section of the demethanizer column. The liquid stream from the very first separation enters a conduit, is expanded and then fed into the demethanizer column, either on top of the lower middle packed section or is selectively heated prior to being fed onto the lowest packed section of the tower. The liquid is recovered through the bottom end of the column and overhead vapor passes out of the other end of the column.

BRIEF DESCRIPTION OF THE DRAWING

The FIGURE discloses a diagrammatic flow sketch of the process.

DESCRIPTION OF THE PREFERRED EMBODIMENT

Referring to the drawings, the numeral 1 indicates the incoming raw feed gas conduit, which leads into the heat exchangers 2A and 2B, and the conduit 1 is separated in vessel 3 into vapor conduit 4, which is divided into conduit 5 and 7, and the bottom conduit 16 is the liquid conduit. Identical vapors pass into conduit 5 and conduit 7. The feed gas in conduit 5, which comprises less than fifty percent of the total inlet feed gas, passes through another heat exchanger 6, which lowers the temperature to liquefy the feed gas before passing it through controlled expansion valve 11 which reduces the pressure, and thence into the upper section of the two stage separator 12.

The second stream of vapor is more than 50 percent of the separated vapor stream, and passes through conduit 7 into a dividing point, where part of the stream of feed gas is selectively diverted through conduit 8, and the controlled expansion valve 9, for control of the reduction of pressure and temperature, but primarily the other part passes through the expander 10, where the pressure and temperature are reduced, and the two streams selectively combine and pass into the two-stage separator 12, where the vapors induced by the expansion pass into the upper section. These vapors are first contacted with the liquid portion of the stream entering the two-stage separator upper portion. The heavier components of the vapor are retained in the liquid phase. The vapor then combines with vapors from the upper section, and passes into the residue gas discharge line 19, leading from the top of the demethanizer column 20. The liquid from the upper section passes into the conduit 14 sending it onto the top section 21 of the demethanizer column 20. The lower section liquid flows into the demethanizer column 20 at a midway point, onto section 22, through conduit 15. The line 16 extends from the high pressure separator 3, carries liquid and vapor after pressure reduction by means of the valve 17, and terminates in the demethanizer column below the midway point onto bed 22 or 23. This arrangement puts a liquid stream into the demethanizer column at the top of the first packed bed 21, and liquid from the cooled feed gas onto the second packed bed 22 in the demethanizer column, and liquid from the feed gas of a higher temperature onto the bottom packed beds 23 or 24 in the demethanizer column. The demethanizer column is selectively maintained over a range of pressures and temperatures depending on process requirements. Both rejection of ethane, to retain propane, and heavier distillates, and recovery of ethane are possible with this process.

Heat exchange unit 26 selectively heats liquid in conduit 16, and heat exchange unit 27 heats the liquid in the bottom of the column 20.

In use, this process will maintain the utility consumption and capacity while increasing ethane recovery from five to fifteen percent over conventional cryogenic processes and in some instances will reduce utility consumption approximately fifteen percent over conventional cryogenic processes while maintaining the same capacity and recovery levels experienced in such processes, or in some instances utility consumption and recovery levels are maintained with a five to fifteen percent increase in capacity.

What we claim is:

1. In a process for the recovery of components of volatile gas containing methane and heavier components by processing said gas through a demethanizer colkmn, said process comprising introducing a stream of feed gas under pressure into a heat exchange unit to lower the temperature of said gas stream, dividing the stream into two main streams, the first of said two main streams being primarily vapors, which are again divided into two portions with one portion cooled by passing same through a heat exchanger, and then through a controlled expansion valve and into the top of a two stage separator, directing the other portion through an expansion means, lowering the pressure and temperature thereof and then through a divider, the lower section of the two-stage separator, and said divider separating the vapors and liquid, discharging the vapors into the upper section for combination with its stripped vapors and thence into a discharge conduit, discharging the liquid in two separate liquid streams from the two stage separator directly into the demethanizer, one liquid stream being fed into the demethanizer column onto the top packed section, and the other stream entering the demethanizer column on top of the second packed section therein, and liquid from the second main stream expanded and fed into the demethanizer at a midway feed point.

2. The process taught in claim 1 wherein the utility consumption and capacity are maintained while increasing ethane recovery five to fifteen percent over conventional cryogenic processes.

3. The process taught in claim 1 wherein the utility consumption is reduced five to fifteen percent while maintaining same capacity and recovery levels as conventional cryogenic processes.

4. The process taught in claim 1 wherein the utility consumption is maintained with increased capacity and the same recovery levels as in a conventional cryogenic process.

5. The process taught in claim 1 wherein a two-stage packed separator is used to effectively lean the gas of its heavier more desirable components, prior to said liquid stream with these desirable components entering a conventional demethanizing column.

* * * * *